United States Patent [19]

Wills et al.

[11] 4,348,025

[45] Sep. 7, 1982

[54] RACQUET

[75] Inventors: Neville D. Wills, Brighton; Sigmund Kwiatkowski, Seacombe Heights, both of Australia

[73] Assignee: Half Court Tennis Pty. Limited, South Australia, Australia

[21] Appl. No.: 227,033

[22] Filed: Jan. 21, 1981

[30] Foreign Application Priority Data

Jan. 24, 1980 [AU] Australia ..... PE2134
Dec. 24, 1980 [AU] Australia ..... PE7070

[51] Int. Cl.[3] ..... A63B 49/00

[52] U.S. Cl. ..... 273/73 R; 273/29 R; 273/61 R; 273/73 D

[58] Field of Search ..... 273/67 R, 73 R, 73 C, 273/73 D, 73 F, 73 G, 73 H, 73 J

[56] References Cited

U.S. PATENT DOCUMENTS

| | | | |
|---|---|---|---|
| 1,523,865 | 1/1925 | Craig | 273/73 D |
| 2,552,020 | 5/1951 | Tribelhorn | 273/73 C |
| 3,515,386 | 6/1970 | Mason | 273/73 R |
| 3,647,211 | 3/1972 | Doessel et al. | 273/73 C |
| 3,856,603 | 12/1974 | Schaefer et al. | 273/73 J X |
| 4,192,505 | 3/1980 | Tabickman et al. | 273/73 C |
| 4,247,104 | 1/1981 | Goldsmith | 273/73 C |
| 4,310,157 | 1/1982 | Greenberg | 273/73 C |

FOREIGN PATENT DOCUMENTS

| | | | |
|---|---|---|---|
| 252133 | 2/1970 | U.S.S.R. | 273/73 C |

*Primary Examiner*—Anton O. Oechsle
*Attorney, Agent, or Firm*—Ladas & Parry

[57] ABSTRACT

A racquet for use in playing a simulated tennis game on a court of reduced dimensions having an area approximately one third that of a standard tennis court. The racquet has a strung weight in the range from 340 to 400 grams, a length between 480 and 500 mms, a center of gravity between 240 and 260 mms from the head extremity of the racquet and a radius of gyration in the range from 156 to 176 mms.

9 Claims, 6 Drawing Figures

RACQUET

This invention relates to a simulated tennis game which will be referred to in the body of this specification as "Half Court Tennis". The game is played on a court which is considerably smaller than the standard tennis court, the preferred dimensions of the half court tennis court being 12.62 m in length and 6.4 m in width. The game is played with a ball which may be compared with but is modified from a standard tennis ball. In brief a half court tennis ball has a rebound coefficient of approximately 0.67 times that of a standard tennis ball and has a mass of 36–40 grams compared with the mass of a standard tennis ball of 54–60 grams and whereas a standard tennis ball is filled with air at a pressure of approximately 10 pounds per square inch, the half court tennis ball contains air at atmospheric pressure. The surface coating of the half court tennis ball is substantially identical to that of a standard tennis ball and the compression factors pertaining to a half court tennis ball are such that the forward compression lies between 4.8 and 5.9 mm and return compression lies between 9 and 11.5 mm. The net in such a court is 785 mm high at the centre of the court and is strung between side posts which are each 825 mm high and are disposed 7 meters apart.

This invention is concerned particularly with racquets for use in a simulated tennis game played on a court of dimensions substantially similar to those referred to above with a ball having the characteristics of the ball above specified, and with a net arranged substantially as specified.

Simulation of the standard tennis game on a reduced court, requires that the following considerations be made:

(a) The feel of the racquet when making a stroke should be, within practical limits, identical to the feel of a standard tennis racquet making an identical stroke in a standard tennis game.

(b) The ball must land in the half court tennis playing area in a position proportionately similar to that of the equivalent of the standard tennis ball in a standard tennis court from the same stroke.

(c) The difficulty experienced by the receiving player in playing his stroke must be equivalent to that of standard tennis.

Optimum dimensions for a half court tennis playing area and characteristics for a half court tennis ball are listed above. In order to determine optimum characteristics for a half court tennis racquet, considerable study has been made of both a theoretical nature and by way of practical experimentation. For the purpose of this study an average player (male) was taken as having a height of 1.75 m. Variations from the average are considered to be small enough to be insignificant for the purpose of this discussion since these variations affect the player's game by no more significant a degree for half court tennis than for standard tennis.

Characteristics of the average player relevant to this study are as follows:

Reach, from shoulder to knuckles; 648 mm. The line of the knuckles is taken as the line along which the racquet will be held. In determining the effect of the racquet length on the total reach of the player, the length from the centre of the grip to the centre of the racquet "sweet spot" is added to the above figure.

Reaction time, for perception of the opponent striking the ball and assessment of flight path to time of initiation of run to position for playing stroke: 0.1 seconds.

Acceleration. The figure used is 5 $m/s^2$. This is somewhat less than is achievable in straight line acceleration (for which most measurements have been made) but allowance must be made for more precise placement and speed control by the tennis player than the straight runner. The figure is also taken as constant as the effect of variations is negligible in examining limiting conditions.

Using the abovementioned dimensions of the playing area, an analysis of a number of critical shots can be made. These include:

From centre of base-line to a point outside the court to intercept a ball hit from the opposing corner, bouncing on the intersection of the service line and the side line;

From back corner to the centre of the service court to intercept a shot dropped over the net; and From the centre of the base-line with the player running the wrong way, stopping, reversing direction and reaching a point half way to the side line.

With the dimensions of the half court tennis playing area it can be shown that the time for each of these movements is in the range of 74% to 80% of that for a standard tennis playing area. This figure is taken as an optimum in terms of racquet specification (combined, as outlined above, with arm dimensions) as well as ball specifications.

It is considered that there are three critical features of a half court tennis racquet in order that optimum simulation of the game of standard tennis might be effected. These features are specified as the weight of the racquet, the total length of the racquet and a radius of gyration which combination of features is devised to provide an aerodynamic drag that the racquet has in use which drag simulates, to a maximum possible extent, the aerodynamic drag of a standard tennis racquet.

It has been found that the strung racquet weight should lie in the range from 320–400 grams, the length of the racquet should lie in the range from 480–500 mm and the radius of gyration should lie in the range of 156 to 176 mms, the centre of gravity of the racquet being located between 240 and 260 mms from the extremity of the racquet head in order that the required aerodynamic drag factor should arise.

Stringing for such a racquet would weigh approximately 16 grams.

The racquet of this invention, in order to provide a close simulation with standard tennis, must feel similar to a tennis racquet and should preferably have a weight distribution in accordance with the following criteria:

(a) A grip of the same general form as a standard tennis racquet;

(b) An overall weight similar to a standard tennis racquet. At the same time it must not feel artificially weighted. The application of weight to an otherwise light racquet does not achieve the required result as it produces a mismatch between the materials' properties, and does not give a satisfactory "feel"; and (c) A rotational moment of inertia similar to that of a standard tennis racquet. Existing racquets for reduced-size court games are light in weight and have this low weight distributed in such a way that their rotational moments of inertia are low enough for it to be feasible for the average player to use wrist movement to control the ball. This is not feasible in full scale tennis, in which a locked wrist at the moment of ball impact is essential, and for this reason such racquets cannot be used to simulate a tennis stroke.

In order to clearly define the preferred racquet characteristics, it is necessary to discuss the concept of the "sweet spot". This is the point in the racquet stringing at which ball impact feels best to the player. It has the following physical characteristics, all of which are interrelated:

(a) It is the point at which maximum energy is transferred from the racquet to the ball. It follows from this that the minimum energy remains in the racquet for the player to absorb after the ball is struck;

(b) It represents a vibrational node of the racquet;

(c) Hitting a ball at the sweet spot induces a vibrational node at the centre of the grip. This implies that no rotational torque is applied about any axis to the grip, and hence to the player's wrist, and the racquet gives the feel of smooth, flowing motion through the ball contact.

In addition to the above, there is a visual conception in the player with any racquet (or any striking instrument) of where the sweet spot ought to be. While action can be taken to move the sweet spot, if it does not "look" to be in the right place, if there is a conflict between the feel and the appearance, it is unsatisfactory. In particular, it is important that the racquet should not have excessive visual mass outboard of the sweet spot.

The specification set by the governing bodies for standard tennis does not include any restriction on weight. The weight and weight distribution used in the specification of the half court tennis racquet is therefore based on typical figures of current tennis racquets.

As indicated above it is required that the weight of the half court tennis racquet, according to this invention, be in the range of 320–400 grams strung. In the light of the above discussion, it is preferred that the centre of gravity of the racquet of this invention be located at a point in the range of 240–260 mm from the head end of the racquet and the radius of gyration of a racquet according to this invention should be in the range of 156–176 mm about the axis through the centre of gravity of the racquet perpendicular to the racquet face.

While the polar moment of inertia is the significant factor in racquet feel, it is more convenient to fix the radius of gyration. This is a measure of the weight distribution given by the frame profile and is unaffected by thickening of the frame to give different total weights. The moment of inertia for any specific racquet is then equal to the mass multiplied by the square of the Radius of Gyration. A figure for a typical standard tennis racquet was measured at 177 mm.

The following formulae are appropriate:

$$T = 2\pi \cdot \sqrt{\frac{K^2 + h^2}{gh}}$$

where

T = period of oscillation

K = radius of gyration h = distance from pivot point to centre of gravity, and $I = mK^2$ where I = moment of inertia m = mass K = radius of gyration As previously indicated the required length of the racquet according to this invention is between 480–500 mm. The grip length of the handle portion of such a racquet should approximate 150 mm but can be longer or shorter to suit the convenience of the individual player.

The final feature which must be considered is the aerodynamics of the racquet and the effect on the racquet of air resistance.

The head of the half court tennis racquet is smaller and moves more slowly than the equivalent standard tennis racquet head. It is therefore necessary to build up the drag coefficient to allow it to simulate, as far as possible, the drag of the standard tennis racquet. As the drag is proportional to the square of the speed of the racquet this requires an increase in drag coefficient reflecting the difference in the squares of those speeds. In addition, it is necessary to place the increased drag as far outward as possible to place the centre of effort of the added drag as near as possible to the position of the centre of pressure of the standard tennis racquet.

This has been achieved in a preferred embodiment of this invention by the addition of a unique enlarged area at the head of the racquet. This area is critical in this embodiment in terms of shape in achieving the required drag without inducing large scale turbulence, which could upset its operation.

It is an object of this invention to provide a racquet for use in a simulated tennis game played on a court of reduced dimensions.

In one broad form the invention provides a racquet which when strung has a weight in the range of 340 to 400 grams, a length between 480 and 500 mms, a centre of gravity located on the longitudinal axis of the racquet in the range from 240 to 260 mms from the extremity of the racquet head and a radius of gyration in the range of 156 to 176 mms.

The weight of gut or synthetic stringing for a racquet as defined above is approximately 16 grams and it is to be clearly understood that the scope of this invention encompasses both a strung racquet and an unstrung racquet which, when strung, falls within the above criteria.

The man skilled in the art will appreciate that there are many ways of developing and weighting a racquet head so that the criteria defined above will be met.

However, one particularly desirable arrangement incorporates provision in a racquet as defined above, of a unique head extremity configuration comprising an outer main frame bounded by substantially parallel outer and inner peripheral lines and a head inner region integral with or rigidly attached to the inner periphery of said main frame, said head inner region including a plurality of pipes through which strings are threaded and a plurality of apertures disposed between adjacent said pipes on either side of the axis of said racquet in symmetrical fashion about said axis.

By way of example only, a preferred embodiment of a racquet according to this invention will now be described with reference to the accompanying drawings wherein.

Figures 1, 2, 3, 4, 5, 6:
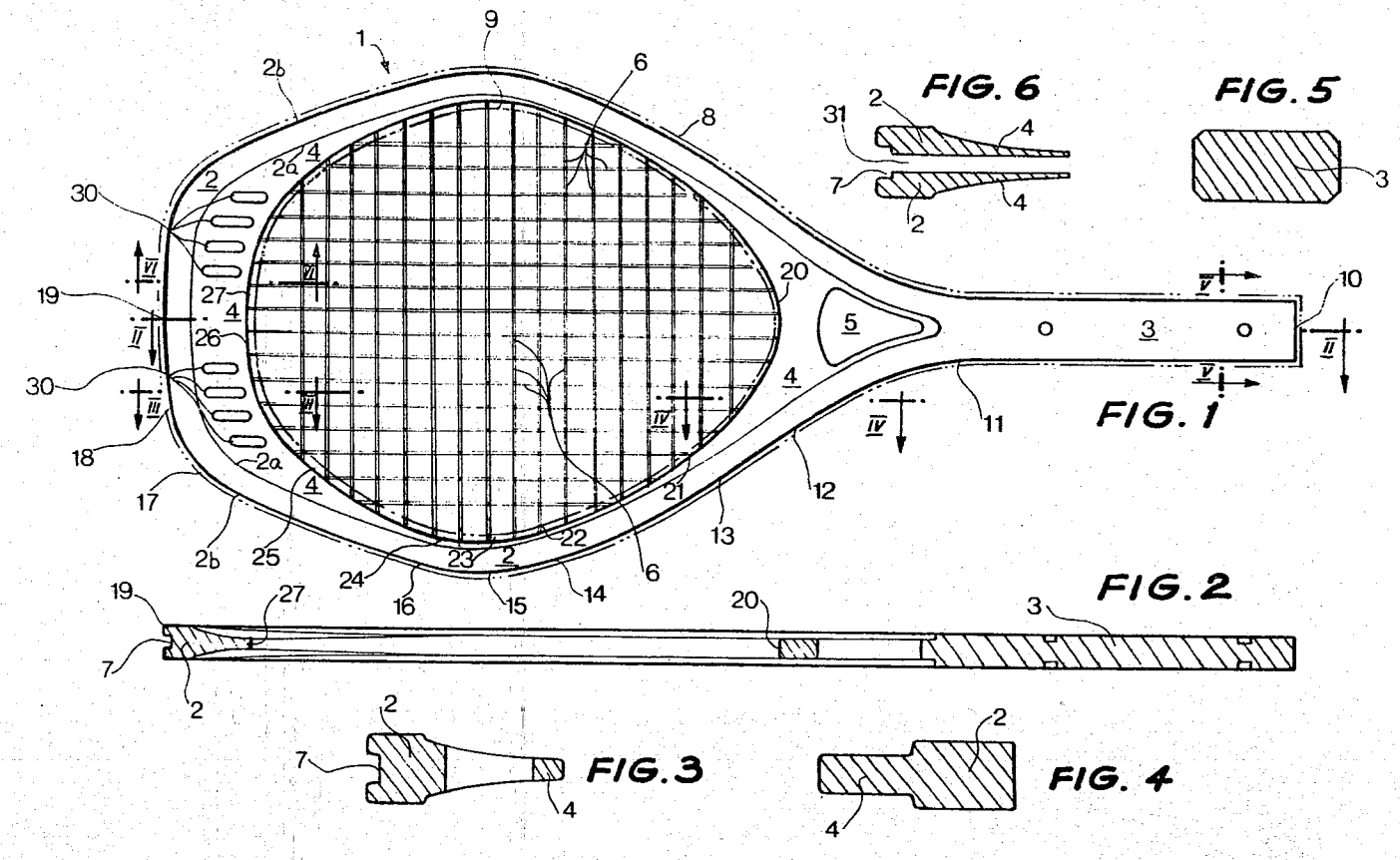
FIG. 1 is a plan view of a strung racquet according to this invention. The shaft only of the handle portion is depicted, as is explained in detail infra.
FIG. 2 is a section taken on the line II—II of FIG. 1 which is the longitudinal axis of the racquet.
FIG. 3 is a section taken on the line III—III of FIG. 1.
FIG. 4 is a section taken on the line IV—IV of FIG. 1.
FIG. 5 is a section taken on the line V—V of FIG. 1.
FIG. 6 is a section taken on the line VI—VI of FIG. 1.

The racquet 1 of this embodiment comprises a number of fundamental elements, namely a unique head configuration incorporating main frame 2 and head inner region 4, handle shaft 3, throat 5 and strings 6. Main frame 2 is bounded by inner and outer peripheral lines 2*a* and 2*b* respectively.

The racquet of this embodiment is provided with 16 longitudinal and 17 transverse strings.

The man skilled in the art will appreciate that an unstrung racquet frame according to this invention may be moulded as a complete unit. The embodiment now described incorporates handle shaft 3 about which is located a grip surface (not shown) of leather or leather-like substance. Between the grip surface and the shaft is located a pair of pallets (not shown), one either side of the shaft, these pallets being composed of resilient material. Thus the racquet of this embodiment consists of the moulded component depicted, the strings 6, the grip and handle pallets referred to above.

The dimensions of the depicted racquet will now be described. In a racquet of the specific shape depicted it is believed that these are optimum dimensions. Outer and inner tolerance lines 8 and 9 respectively are indicated each 10 mms removed from the depicted frame. In this description two basic references are used, these being the longitudinal axis of the racquet which lies along line II—II of FIG. 1, and the end of the handle shaft. As the racquet is symmetrical about its axis the shape of the racquet on one side only of that axis is described.

The total length of racquet 1 is 497 mm and main frame 2 is taken to commence at a point 152.4 mms from end 10 of handle shaft 3. The cross-section of the main frame 2 is rectangular being 11.4 mms wide in the plane of the racquet and 14.0 mms thick. The thickness may vary between 9.0 and 19.0 mms to provide control of the weight and other physical characteristics of the racquet. The corners of the cross-section are rounded with radius of 2.0 mms.

The frame includes apertures through which the strings are strung and a groove 7 may be provided around part or all of the periphery of the main frame 2 in order to provide a measure of protection for portions of strings 6 disposed in that region of the racquet.

The outer edge of the main frame passes through nine reference points as follows:

(a) Point 11, 152.4 mms along the racquet axis from end 10 of racquet 1 and 14.0 mms from the racquet axis. From point 11 the frame follows a hyperbolic arc, this hyperbola having its focus 26.2 mms from the axis of racquet 1 and its apex at point 11.

(b) Point 12, at the end of the hyperbolic arc referred to in (a) above, is located 231.1 mms along the racquet axis from end 10 and 50.8 mms from the axis. From point 12 the outer frame follows a straight line making an angle of 36° 40′ with the racquet axis to point 13.

(c) Point 13 is located 248.2 mms along the racquet axis from end 10 and 63.5 mms from the axis. From point 13 the outer frame follows a circular arc of radius 308.4 mms to point 14.

(d) Point 14 is located 326.4 mms along racquet axis from end 10 and 104.1 mms from that axis. From point 14 the outer frame follows a circular arc of radius 98.4 mms to point 15.

(e) Point 15 is located on the circular arc referred to in (d) above at which the arc is tangential to a line parallel to the racquet axis and 110 mms removed therefrom. This point is at the maximum width of the racquet.

(f) Point 16 is located on the arc of the circle referred to in (e) above such that the arc length from point 14 to point 16 is 61.8 mms. From point 16 the outer frame follows a circular arc of radius 393.7 mms to point 17.

(g) Point 17 is located 472.7 mms along the racquet axis from end 10 and 71.9 mms from the axis. From point 17 the outer frame follows a circular arc of radius 41.1 to point 18.

(h) Point 18 is located 494.0 mms along the racquet axis from end 10 and 44.4 mms from the axis. From point 18 the outer frame follows a circular arc of radius 294.4 mms extending to point 19.

(i) Point 19, at the extremity of the racquet head, is on the racquet axis and 487.8 mms from end 10.

The inner periphery of head inner region 4 is shaped as follows:

(j) Point 20 is a point on the racquet axis 229.4 mms from end 10. From this point the inner frame periphery follows a parabolic path, the parabola having its focus at a point 253.8 mms along the racquet axis from end 10, its apex at point 20, and extending to point 21.

(k) Point 21 is located 267.5 mms along the racquet axis from end 10 and 58.4 mms from that axis. From this point the inner frame profile follows a circular arc of radius 256.0 mms to point 22.

(l) Point 22 is located 339.3 mms along and 94.5 mms from the racquet axis. From point 22 the inner main frame profile follows a circular arc of radius 60.0 mms to point 23.

(m) Point 23 is located on the circular arc referred to in (l) above at which that arc is tangential to a line parallel to the racquet axis and 96.8 mms therefrom. This point locates the maximum width of the head opening of racquet 1. The inner periphery then follows the arc referred to in (l) above to point 24.

(n) Point 24 is located on the said circular arc such that the arc length from point 22 to point 24 is 35.6 mms. From this point a further circular arc of radius 250.0 mms is traced to point 25.

(o) Point 25 is located 435.1 mms along the racquet axis from end 10 and 65.5 mms from that axis. From this point a further circular curve of radius 62.5 mms is traced to point 26.

(p) Point 26 is located 460.2 mms along the racquet axis from end 10 and 20.3 mms from that axis. From point 26 a circular curve of radius 292.0 mms is traced to point 17.

(q) Point 27 is located on the racquet axis and 463.1 mms therealong from end 10.

Handle shaft 3 is in the general shape of a rectangular prism 28.2 mms wide in the plane of the racquet face and of thickness equal to that of the main frame 2. The edges of handle shaft 3 may be rounded or chamfered. Handle shaft 3 extends 152.4 mms from end 10 to a section of the racquet normal to the racquet axis and including point 11. In this embodiment the handle outer end is located as indicated at point 10 but the end of the handle shaft may be displaced relative to the said section including point 11 within limits of 20 mms either way from end point 10.

Head inner region 4, located within and either rigidly joined to or integral with main frame 2, will now be described.

The cross-section of region 4 where it is located between the head end of the frame (point 19) and the widest point of the frame (point 15) is in the form of a truncated triangle (see FIG. 2) with base 11.7 mms wide integral with (or attached to) and symmetrical with the inner portion of main frame 2.

The upper edge of this triangle is defined by the profile of the inner periphery of inner head region 4 described above.

Where it is located between the widest point 15 of the frame and the handle (point 11) its cross-section is rectangular of thickness 11.7 mms (variable over the range 6.7 to 16.7 mms), is placed symmetrically within main frame 2 with its inner edge defined by the profile of the inner periphery of inner region 4 described above.

The throat region 5 is provided with an opening which is symmetrical about the axis of the racquet.

Inner head region 4 derives its uniqueness from provision therein of a plurality of apertures 30 in that portion of region 4 furtherest from handle shaft 3. These apertures are slots 4.2 mms wide and of length between 15 and 20 mms with radiused ends. Eight such apertures 30 are shown, their axes being parallel with racquet axis II—II and the apertures being symmetrically disposed about axis II—II. Between adjacent apertures pipes 31 (FIG. 6) through each of which is threaded a string 6, are located.

Apertures 30 reduce turbulence during swinging of the racquet 1, enabling creation of a desirably stable air flow in the vicinity of the racquet head.

What we claim is:

1. A racquet having a strung weight in the range of 340 to 400 grams, a length between 480 and 500 mms, a centre of gravity located on the longitudinal axis of the racquet in the range of from 240 to 260 mms from the extremity of the racquet head and a radius of gyration about an axis perpendicular to the racquet plane and passing through said centre of gravity in the range from 156 to 176 mms.

2. A racquet as defined in claim 1 comprising a unique head extremity configuration comprising an outer main frame bounded at the head of said racquet by substantially parallel outer and inner peripheral lines and a head inner region contiguous with the inner periphery of said main frame, said head extremity configuration including a plurality of pipes through which strings are threaded and a plurality of apertures disposed between adjacent said pipes on either side of the axis of said racquet in symmetrical fashion about said axis.

3. An unstrung racquet frame having a weight in the range 314 to 384 grams which when strung provides a racquet as defined in claim 1 or claim 2.

4. A racquet as defined in claim 2 wherein each of said apertures has a longitudinal axis substantially parallel to the racquet axis, there being four apertures on either side of the racquet axis.

5. A racquet as defined in claim 4 wherein each said aperture is of length betwen 15 and 20 mms and of width between 4 and 4.5 mms.

6. A racquet as defined in claim 1 or claim 2 further comprising a throat opening symmetrical about the racquet axis.

7. A racquet as defined in claim 1 or claim 2 wherein the frame is moulded in a single piece incorporating a handle shaft and wherein a pair of pallets is added one either side of said handle shaft and a grip wound around said pallets and said shaft to complete said handle.

8. A racquet as defined in claim 1 or claim 2 having 16 strings in the longitudinal direction and 17 strings in the transverse direction.

9. A racquet as defined in claim 1 or claim 2 further comprising a groove located around part or all of the circumference of the head of said racquet to locate stringing for protection thereof.

* * * * *